US012478832B2

(12) United States Patent
Tsai

(10) Patent No.: US 12,478,832 B2
(45) Date of Patent: Nov. 25, 2025

(54) FRAME TYPE LEG LIFT MACHINE

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 118 days.

(21) Appl. No.: 18/390,331

(22) Filed: Dec. 20, 2023

(65) Prior Publication Data

US 2025/0205548 A1 Jun. 26, 2025

(51) Int. Cl.
*A63B 23/04* (2006.01)
*A63B 21/00* (2006.01)

(52) U.S. Cl.
CPC .... *A63B 23/0405* (2013.01); *A63B 21/00192* (2013.01); *A63B 21/159* (2013.01); *A63B 21/4034* (2015.10)

(58) Field of Classification Search
CPC ..... A63B 23/0405; A63B 23/04; A63B 21/00192; A63B 21/159; A63B 21/4034; A63B 21/005–0053; A63B 22/001; A63B 22/0664
See application file for complete search history.

(56) References Cited

U.S. PATENT DOCUMENTS 5,792,027 A * 8/1998 Gvoich ..... A63B 21/4047 482/52
6,036,622 A * 3/2000 Gordon ..... A63B 22/001 482/70
6,135,926 A * 10/2000 Lee ..... A63B 22/001 482/57
6,440,042 B2 * 8/2002 Eschenbach ..... A63B 22/0664 482/52
7,425,189 B1 * 9/2008 Eschenbach ..... A63B 69/18 482/52
7,651,445 B1 * 1/2010 Chen ..... A63B 22/001 482/52
7,722,505 B2 * 5/2010 Liao ..... A63B 21/225 482/52
9,067,094 B2 * 6/2015 Chang ..... A63B 22/0015
9,669,256 B2 * 6/2017 Wu ..... A63B 21/00069
10,549,147 B2 * 2/2020 Gordon ..... A63B 22/0017
11,596,830 B2 * 3/2023 Dalebout ..... A63B 21/154
12,220,606 B2 * 2/2025 Liao Lai ..... F16H 57/02
12,337,203 B1 * 6/2025 Tsai ..... A63B 21/159
2009/0062079 A1 * 3/2009 Kuo ..... A63B 22/0056 482/52

(Continued)

*Primary Examiner* — Loan B Jimenez
*Assistant Examiner* — Kathleen M Fisk
(74) *Attorney, Agent, or Firm* — LANWAY IPR SERVICES; Chun-Ming Shih

(57) ABSTRACT

A frame type leg lift machine includes a main frame unit, two drive levers, two pedals, and at least one linkage mechanism. The main frame unit includes a bottom frame, an upper support frame, two first stands, two second stands, and a handle rack. The first stands and the second stands are connected between the bottom frame and the upper support frame. The handle rack is connected with the upper support frame. The upper end of each of the drive levers is pivotally mounted on one of the second stands. Each of the pedals is pivotally mounted on the lower end of one of the drive levers. The at least one linkage mechanism has a first end pivotally connected with the main frame unit and a second end pivotally connected with the upper end of each of the drive levers.

6 Claims, 14 Drawing Sheets

(56) References Cited

U.S. PATENT DOCUMENTS

| | | | | |
|---|---|---|---|---|
| 2009/0069159 | A1* | 3/2009 | Wang | A63B 22/02 482/54 |
| 2015/0375030 | A1* | 12/2015 | Yang | A63B 22/001 482/52 |
| 2023/0054522 | A1* | 2/2023 | Liao Lai | A63B 21/154 |

* cited by examiner

FRAME TYPE LEG LIFT MACHINE

BACKGROUND OF THE INVENTION

Field of the Invention

The present invention relates to an exercising machine and, more particularly, to a frame type leg lift (or raise or extension) machine.

Description of the Related Art

A conventional leg lift machine generally comprises a base, a front handlebar rack, a seat mount, a driving mechanism, a magnetically controlled resistance mechanism, and a linkage mechanism. The driving mechanism includes two driving levers. Each of the driving levers has a first end swingably connected to the seat mount and a second end pivotally connected with a pedal. The driving mechanism further includes sprockets and chains mounted between the seat mount and the driving levers. The magnetically controlled resistance mechanism is driven by the sprockets in a one-way direction to produce a resistance. The linkage mechanism is connected with the driving levers so that the driving levers swing in two opposite directions.

However, the conventional leg lift machine has the following disadvantages.

1. The sprockets and the chains are expensive and increase the cost of production. In addition, it takes much time to adjust the sprockets and the chains so that the sprockets and the chains are rotated smoothly.
2. The magnetically controlled resistance mechanism is operated by an eddy current and does not have an inertia effect so that the user is not easily accustomed to the magnetically controlled resistance mechanism.
3. The base has a long and narrow structure so that it easily tips or topples leftward or rightward when the user lifts legs. In addition, other people is easily hit when close to the user during the leg raising movement.

BRIEF SUMMARY OF THE INVENTION

The primary objective of the present invention is to provide a frame type leg lift machine that provides an exercising effect comfortably.

In accordance with the present invention, there is provided a leg lift machine comprising a main frame unit, two drive levers, two pedals, and at least one linkage mechanism. The main frame unit includes a bottom frame, an upper support frame, two first stands, two second stands, and a handle rack. The two first stands are connected between the bottom frame and the upper support frame and arranged at a front side of the main frame unit. The two second stands are connected between the bottom frame and the upper support frame and arranged at a rear side of the main frame unit. The handle rack is connected with and extends upward from the upper support frame. Each of the two drive levers has an upper end and a lower end. The upper end of each of the two drive levers is provided with a pivot portion extending outward. The upper end of each of the two drive levers is pivotally mounted on one of the two second stands of the main frame unit. Thus, the upper end of each of the two drive levers is served as a rotation fulcrum, and the two drive levers are pivoted relative to the main frame unit and reciprocally swing forward and backward and move along a curved trajectory. Each of the two pedals is pivotally mounted on the lower end of one of the two drive levers. The at least one linkage mechanism has a first end pivotally connected with the main frame unit and a second end pivotally connected with the pivot portion of the upper end of each of the two drive levers.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
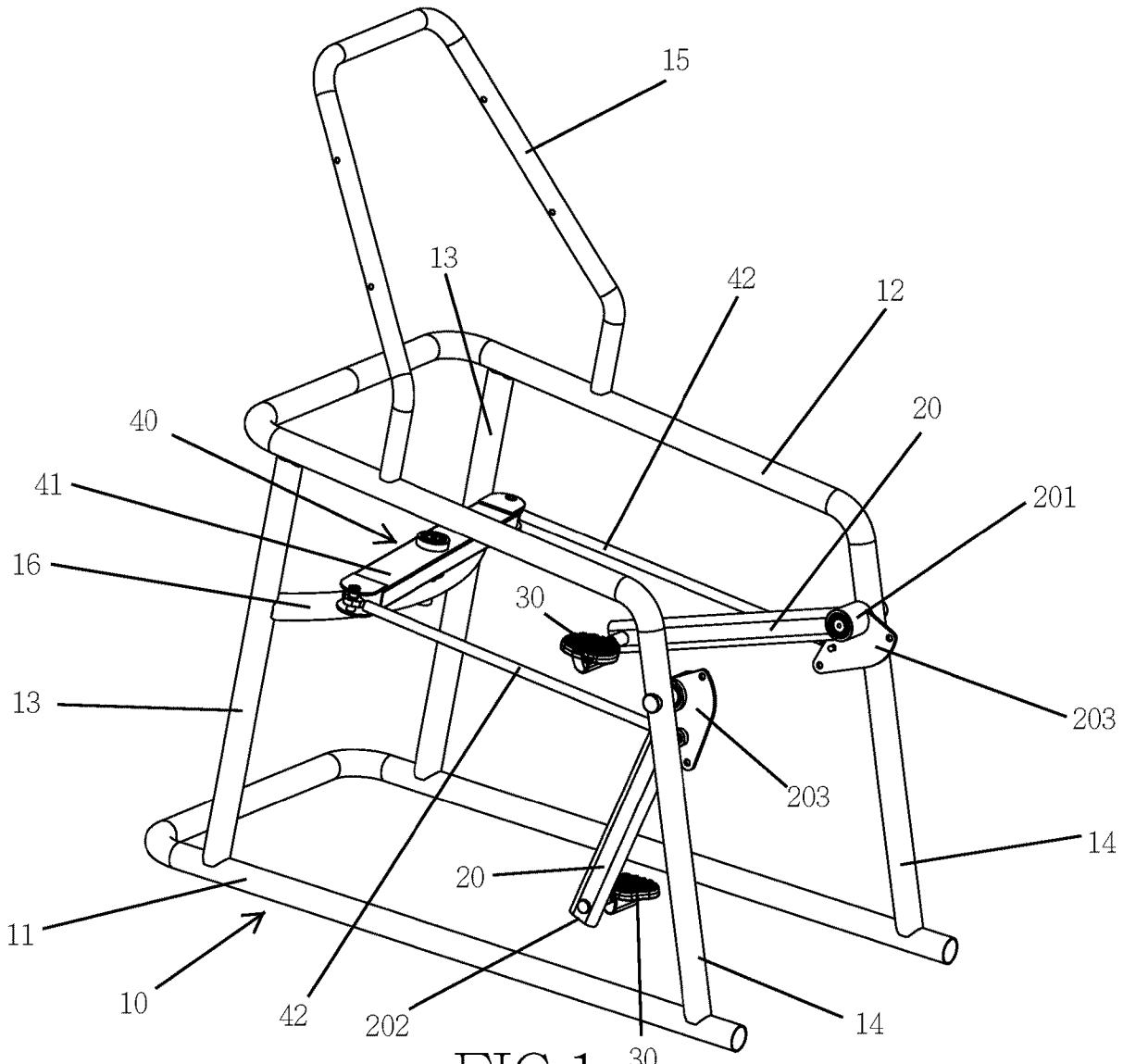
FIG. 1 is a perspective view of a leg lift machine in accordance with the first preferred embodiment of the present invention.
Figure 2:
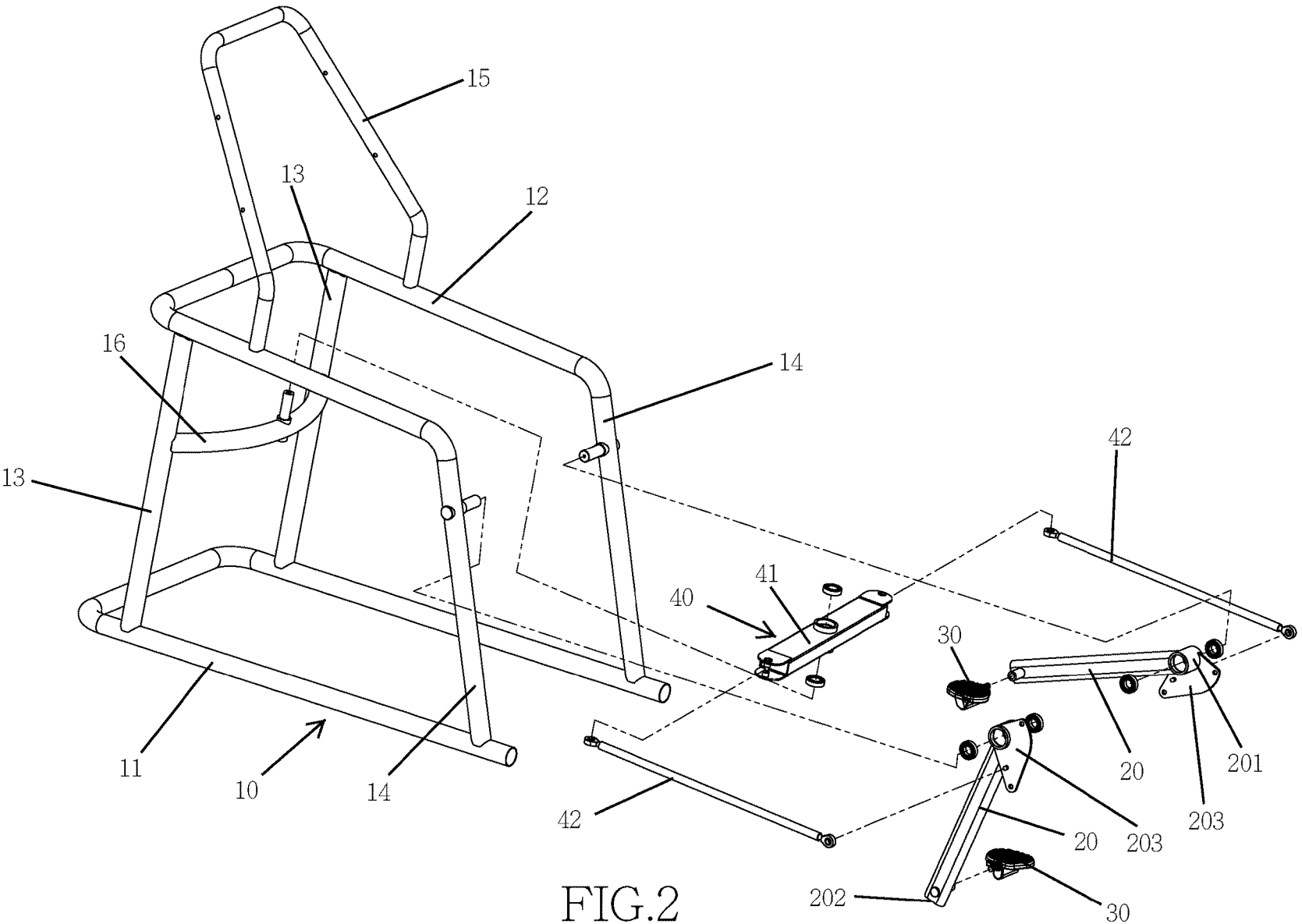
FIG. 2 is an exploded perspective view of the leg lift machine as shown in FIG. 1.
Figure 3:
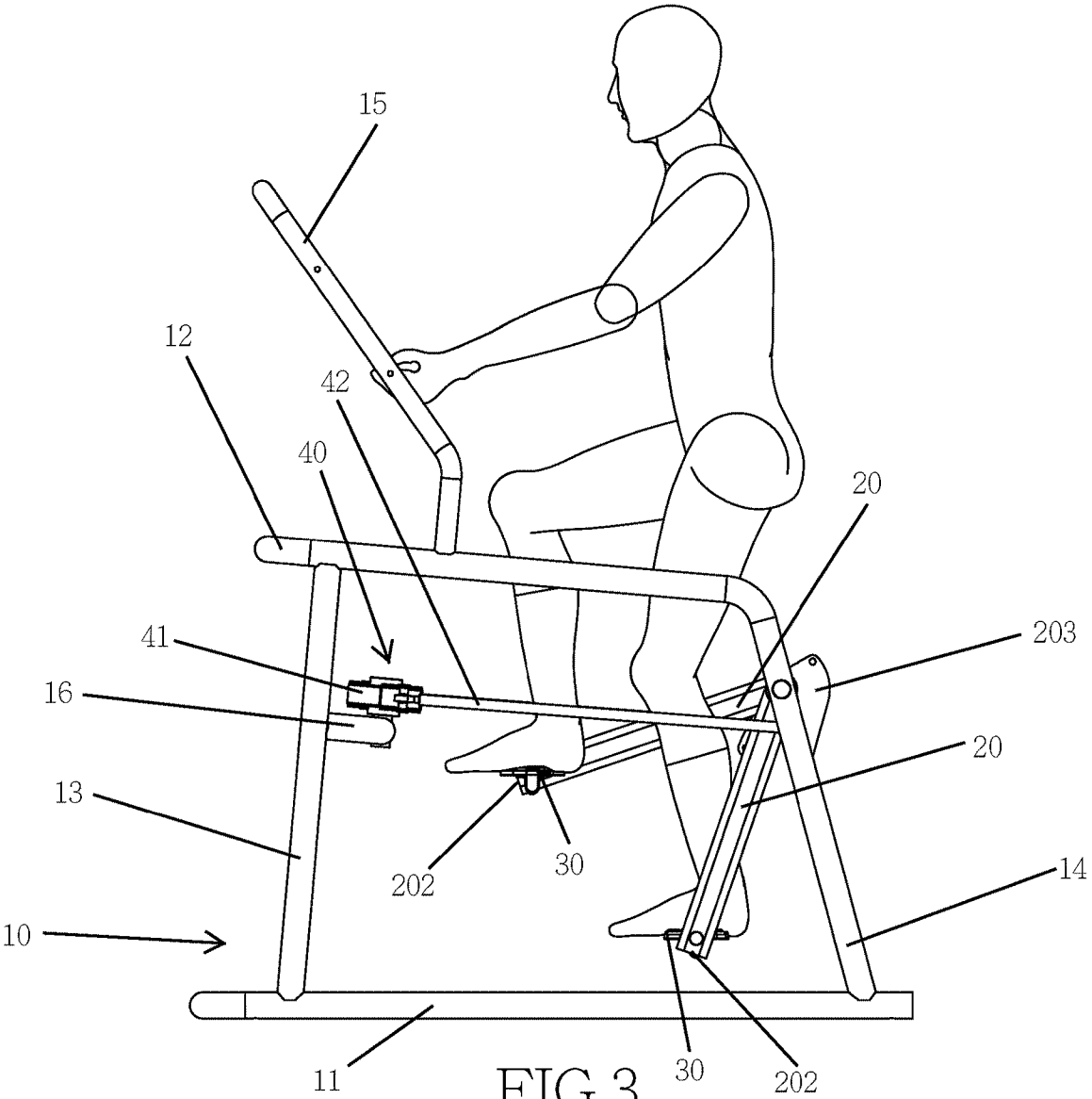
FIG. 3 is a side operational view of the leg lift machine as shown in FIG. 1.

Referring to the drawings and initially to FIGS. 1-3, a leg lift machine in accordance with the preferred embodiment of the present invention comprises a main frame unit 10, two drive levers 20, two pedals 30, and at least one linkage mechanism 40.

The main frame unit 10 includes a bottom frame 11, an upper support frame 12, two first stands 13, two second stands 14, and a handle rack 15. The two first stands 13 are connected between the bottom frame 11 and the upper support frame 12 and arranged at a front side of the main frame unit 10. The two second stands 14 are connected between the bottom frame 11 and the upper support frame 12 and arranged at a rear side of the main frame unit 10. The handle rack 15 is connected with and extends upward from the upper support frame 12.

Each of the two drive levers 20 has an upper end 201 and a lower end 202. The upper end 201 of each of the two drive levers 20 is provided with a pivot portion 203 extending outward. The upper end 201 of each of the two drive levers 20 is pivotally mounted on one of the two second stands 14 of the main frame unit 10. Thus, the upper end 201 of each of the two drive levers 20 is served as a rotation fulcrum, and the two drive levers 20 are pivoted relative to the main frame unit 10 and reciprocally (or alternatingly) swing forward and backward and move along a curved trajectory (or track).

Each of the two pedals 30 is pivotally mounted on the lower end 202 of one of the two drive levers 20.

The at least one linkage mechanism 40 has a first end pivotally connected with the main frame unit 10 and a second end pivotally connected with the pivot portion 203 of the upper end 201 of each of the two drive levers 20.

In the preferred embodiment of the present invention, the main frame unit 10 has a cuboid frame shape.

In the preferred embodiment of the present invention, a first front support 16 is securely connected with the front side of the main frame unit 10. The first front support 16 is arranged transversely. The linkage mechanism 40 includes a swing base 41 and two linkage rods 42. The swing base 41 is pivotally mounted on the first front support 16 and symmetrically swings leftward and rightward. Each of the two linkage rods 42 has a front end pivotally connected with one of two ends of the swing base 41. Each of the two linkage rods 42 has a rear end pivotally connected with the pivot portion 203 of the upper end 201 of one of the two drive levers 20. Thus, the two drive levers 20 are limited by the swing base 41 and the two linkage rods 42 to reciprocally swing forward and backward.

In operation, referring to FIG. 3 with reference to FIGS. 1 and 2, the user stands on the two pedals 30, with his/her two hands holding the handle rack 15 and two feet treading the two pedals 30. In such a manner, the two pedals 30 drive and move the two drive levers 20, so that the two drive levers 20 are pivoted relative to the main frame unit 10 freely. At this time, each of the two linkage rods 42 is driven by the pivot portion 203 of the upper end 201 of one of the two drive levers 20, and the swing base 41 is driven by the two linkage rods 42 so that the swing base 41 reciprocally swings forward and backward. In such a manner, the two drive levers 20 are limited by the swing base 41 and the two linkage rods 42 to reciprocally swing forward and backward. Thus, the two drive levers 20 reciprocally swing forward and backward and move along a curved trajectory. Therefore, the user can raise legs to achieve an exercising effect.

Referring to FIGS. 4-10, the leg lift machine further comprises two handlebars 90 pivotally mounted on two sides of the main frame unit 10, and two linking levers 91 each having a front end pivotally connected with a lower end of one of the two handlebars 90 and a rear end pivotally connected with the pivot portion 203 of the upper end 201 of one of the two drive levers 20. Preferably, the two handlebars 90 are pivotally mounted on two sides of the upper support frame 12.

In the preferred embodiment of the present invention, a second front support 17 is securely connected with the front side of the main frame unit 10. The second front support 17 is arranged transversely. A third front support 18 is securely connected with the front side of the main frame unit 10. The third front support 18 is arranged transversely. The main frame unit 10 further includes two pivot ears 131 mounted on the two first stands 13. The leg lift machine further comprises a transmission mechanism 60 and a magnetically controlled resistance mechanism 70. The transmission mechanism 60 is arranged in the main frame unit 10 and includes a shaft 61, a first bevel gear 62, and a second bevel gear 63. The shaft 61 has two ends pivotally mounted on the two pivot ears 131. The first bevel gear 62 is axially secured on the shaft 61. The second bevel gear 63 is pivotally mounted on the second front support 17 and meshes with the first bevel gear 62. The magnetically controlled resistance mechanism 70 is driven by the second bevel gear 63 and provides a resistance to the second bevel gear 63. The magnetically controlled resistance mechanism 70 is arranged in the main frame unit 10 and at least includes a belt wheel 71, a rotation wheel 72, a magnetically controlled wheel 73, a magnetic bracket 74, and a transmission belt 75. The magnetically controlled wheel 73 is pivotally mounted on the third front support 18. The magnetic bracket 74 is securely connected with the second front support 17 and surrounds a periphery of the magnetically controlled wheel 73. The belt wheel 71 is pivotally mounted on the second front support 17 and is rotated in concert with the second bevel gear 63 synchronously. The belt wheel 71 is coaxial with the second bevel gear 63. The rotation wheel 72 is pivotally mounted on the third front support 18 and is rotated in concert with the magnetically controlled wheel 73 synchronously. The rotation wheel 72 is coaxial with the magnetically controlled wheel 73. The transmission belt 75 is mounted (or wound) around the belt wheel 71 and the rotation wheel 72.

In the preferred embodiment of the present invention, the leg lift machine further comprises two swinging mechanisms 50. Each of the two swinging mechanisms 50 includes a rear swinging lever 51, a rear pivot member 52, a lower swinging lever 53, and a front pivot member 54. The rear pivot member 52 is pivotally mounted on one of the two second stands 14 of the main frame unit 10. The rear swinging lever 51 has an upper end pivotally connected with the pivot portion 203 of the upper end 201 of one of the two drive levers 20. The rear swinging lever 51 has a lower end pivotally connected with a first end of the rear pivot member 52. The rear pivot member 52 has a second end pivotally connected with a rear end of the lower swinging lever 53. The lower swinging lever 53 has a front end pivotally connected with a first end of the front pivot member 54. The front pivot member 54 has a second end radially secured on the shaft 61. The shaft 61 extends through the front pivot member 54 of each of the two swinging mechanisms 50.

In the preferred embodiment of the present invention, the leg lift machine further comprises a lifting mechanism 80 mounted on a front section of a bottom of the main frame unit 10. The lifting mechanism 80 drives the main frame unit 10 to lift or lower the main frame unit 10, to further change different inclined angles of the main frame unit 10. The lifting mechanism 80 includes a lifting rack (or bracket) 81, two rollers 82, and a lifter (or lifting gear) 83. The lifting rack 81 has a first end pivotally connected with the main frame unit 10. The lifting rack 81 has a second end pivotally connected with the two rollers 82. The lifter 83 is mounted between the main frame unit 10 and the lifting rack 81 and has a first end pivotally connected with the main frame unit 10 and a second end pivotally connected with the lifting rack 81.

Figure 4:
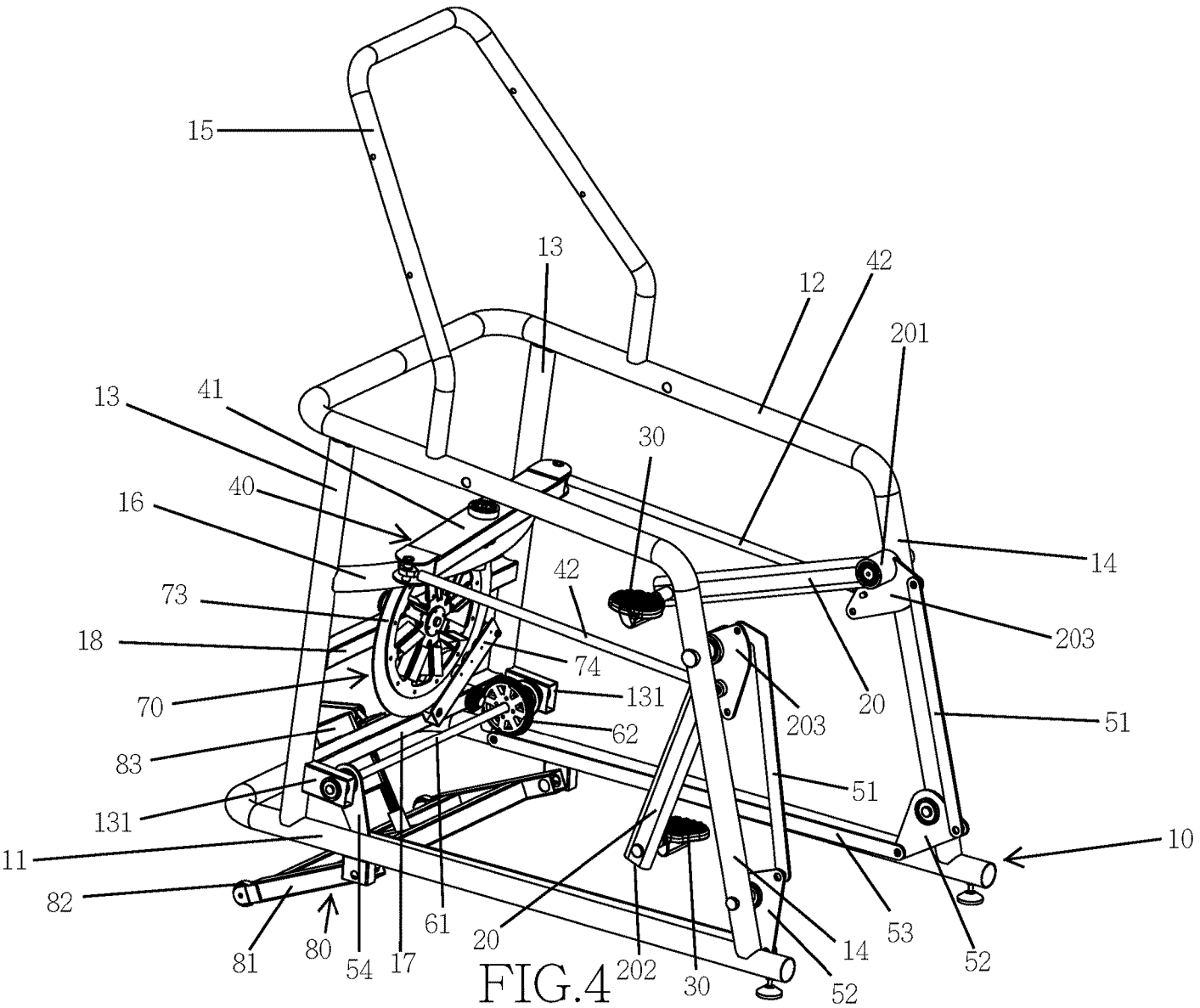
FIG. 4 is a perspective view of a leg lift machine in accordance with the second preferred embodiment of the present invention.
Figure 5:
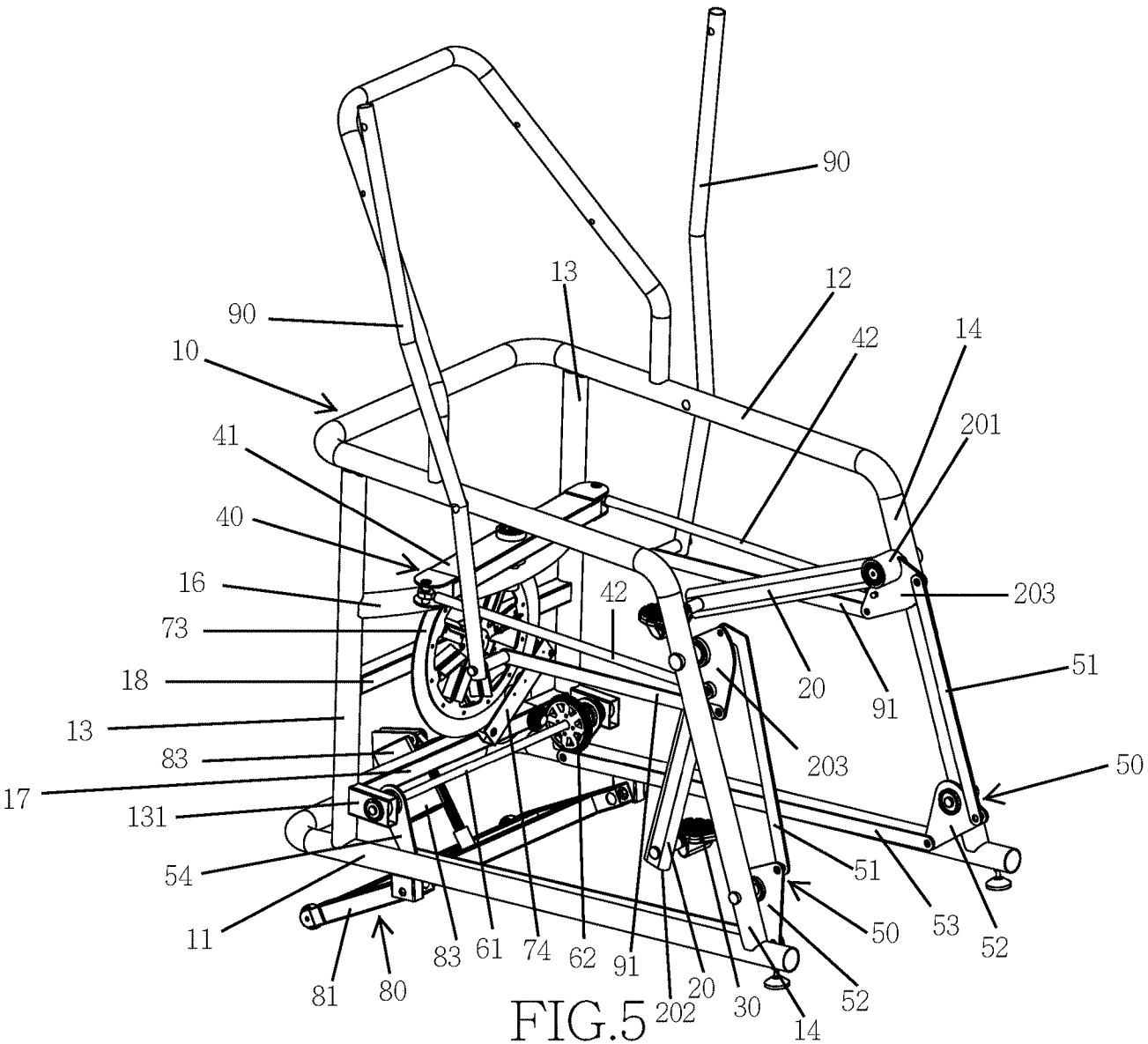
FIG. 5 is a perspective view of a leg lift machine in accordance with the third preferred embodiment of the present invention.
Figure 6:
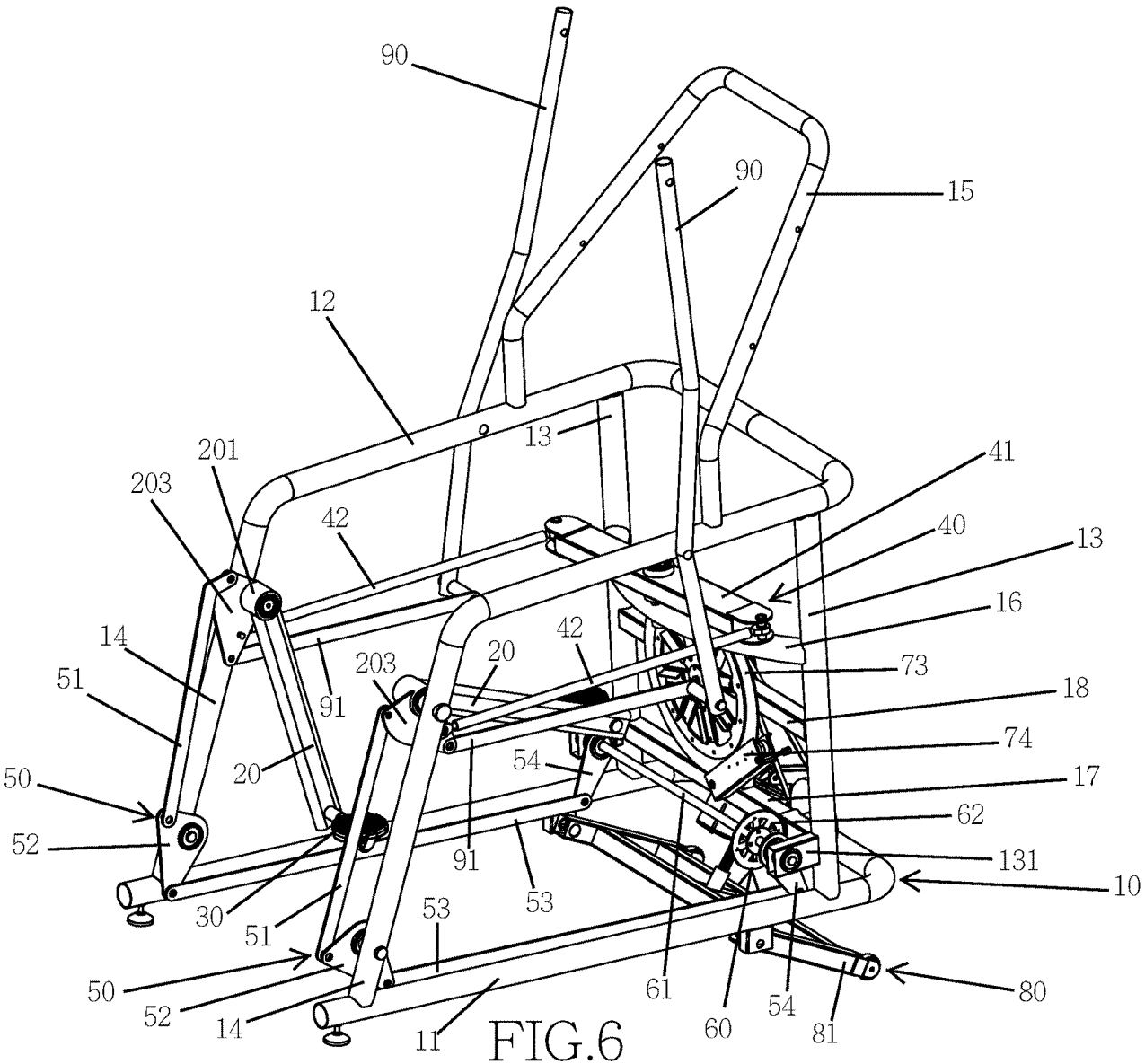
FIG. 6 is another perspective view of the leg lift machine in accordance with the third preferred embodiment of the present invention.
Figure 7:
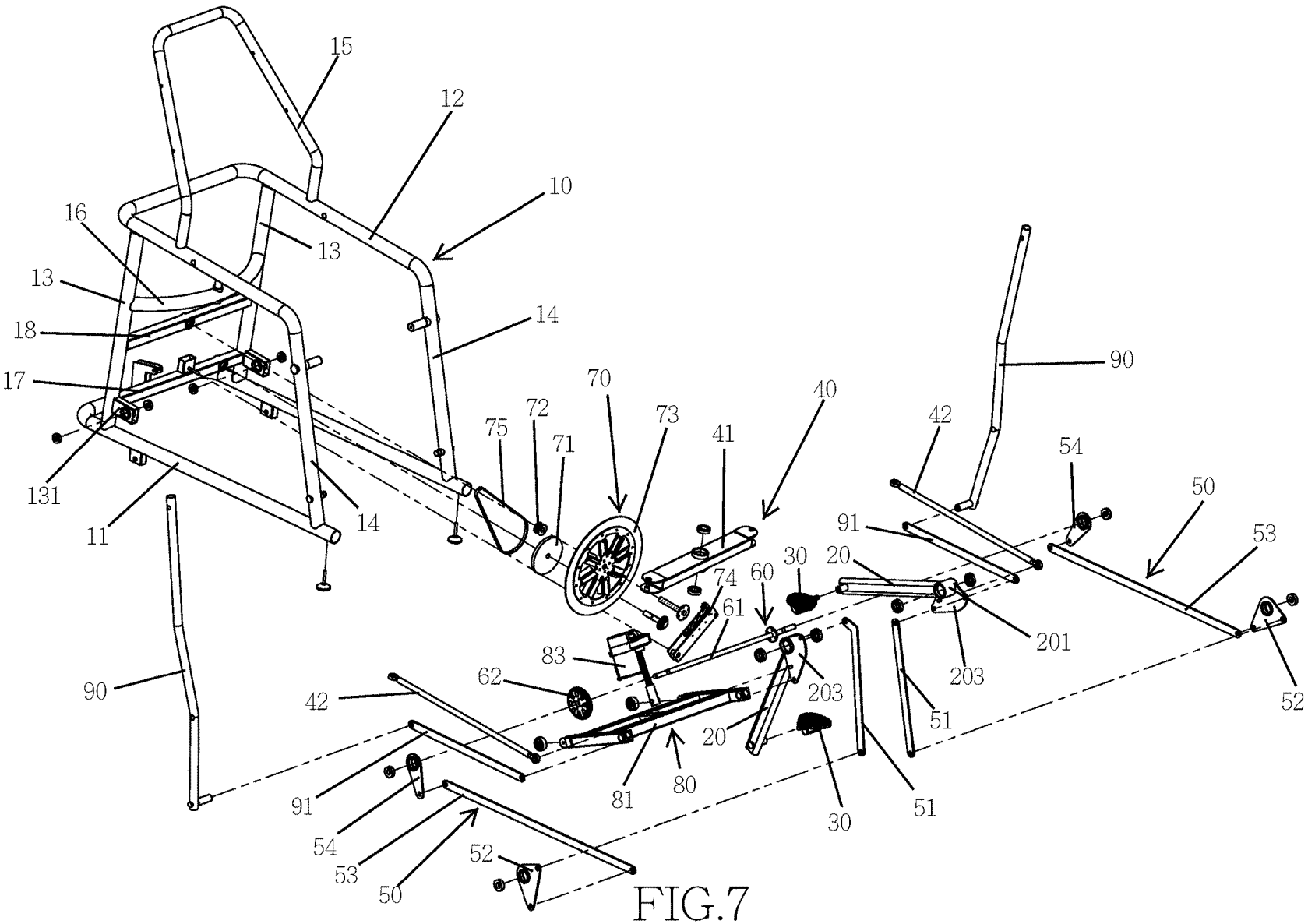
FIG. 7 is an exploded perspective view of the leg lift machine as shown in FIG. 5.
Figure 8:
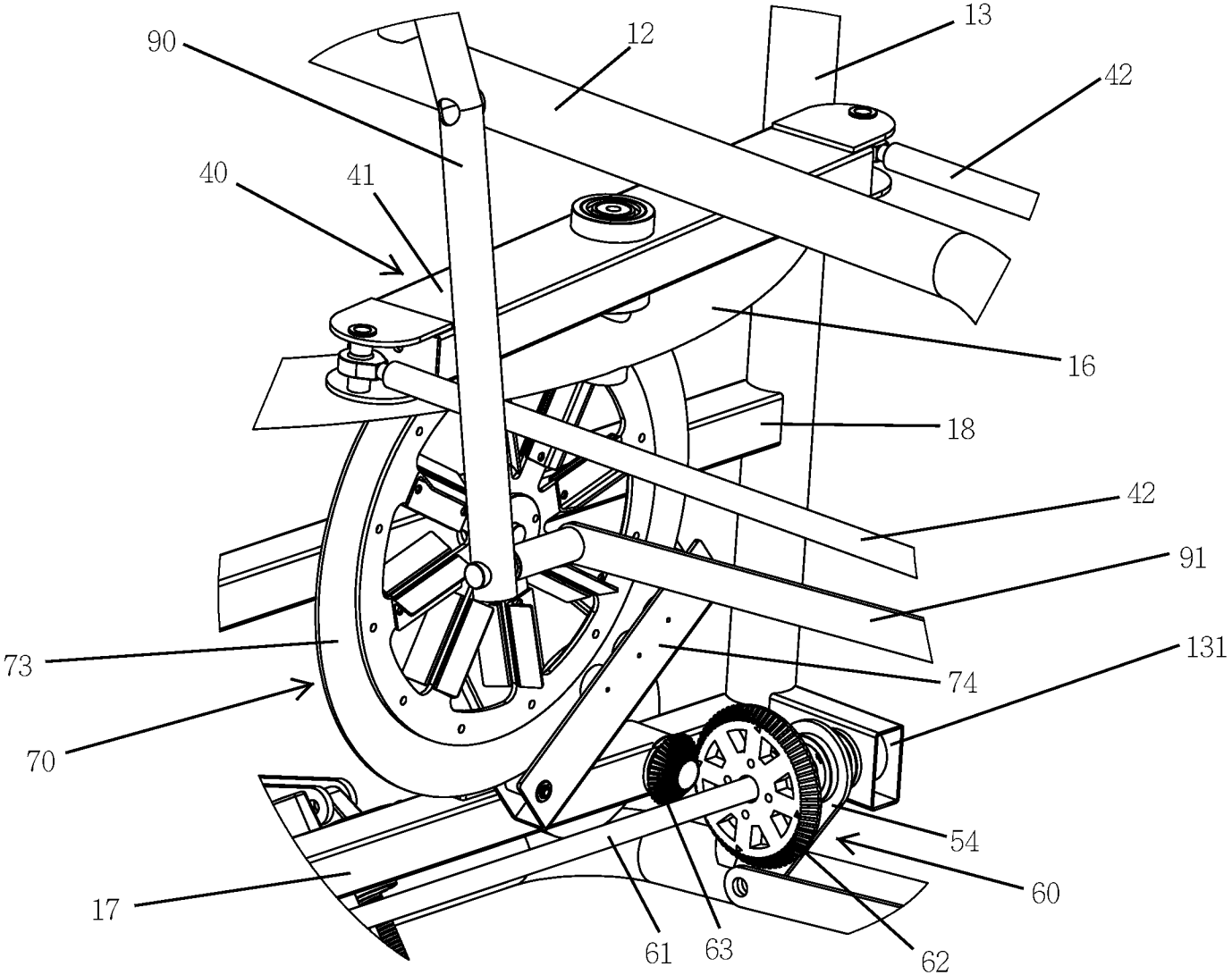
FIG. 8 is a locally enlarged view of the leg lift machine as shown in FIG. 5.
Figure 9:
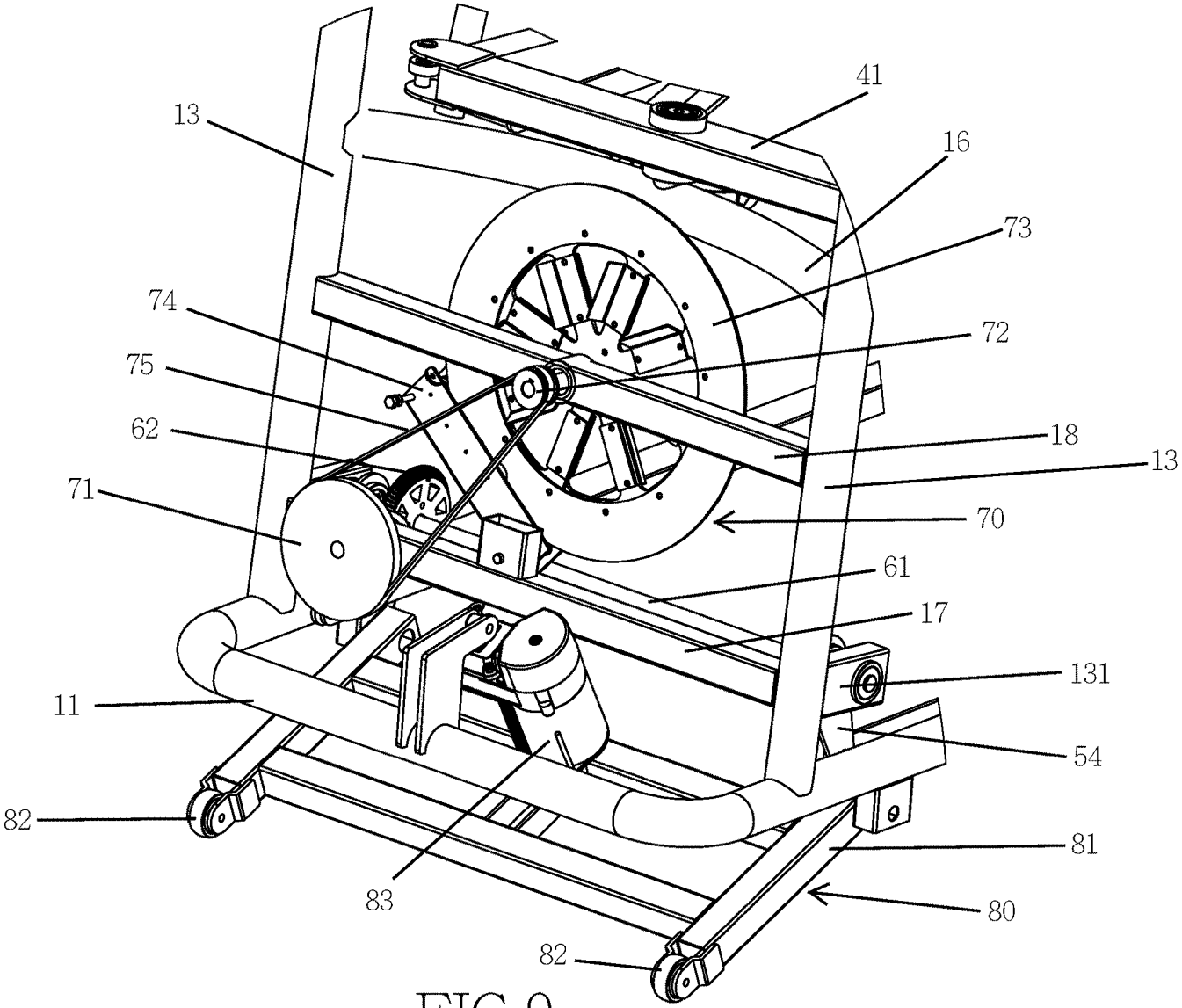
FIG. 9 is another locally enlarged view of the leg lift machine in accordance with the third preferred embodiment of the present invention.

As shown in FIG. 4, the leg lift machine does not have the two handlebars 90 and the two linking levers 91 shown in FIGS. 5-10.

Figure 10:
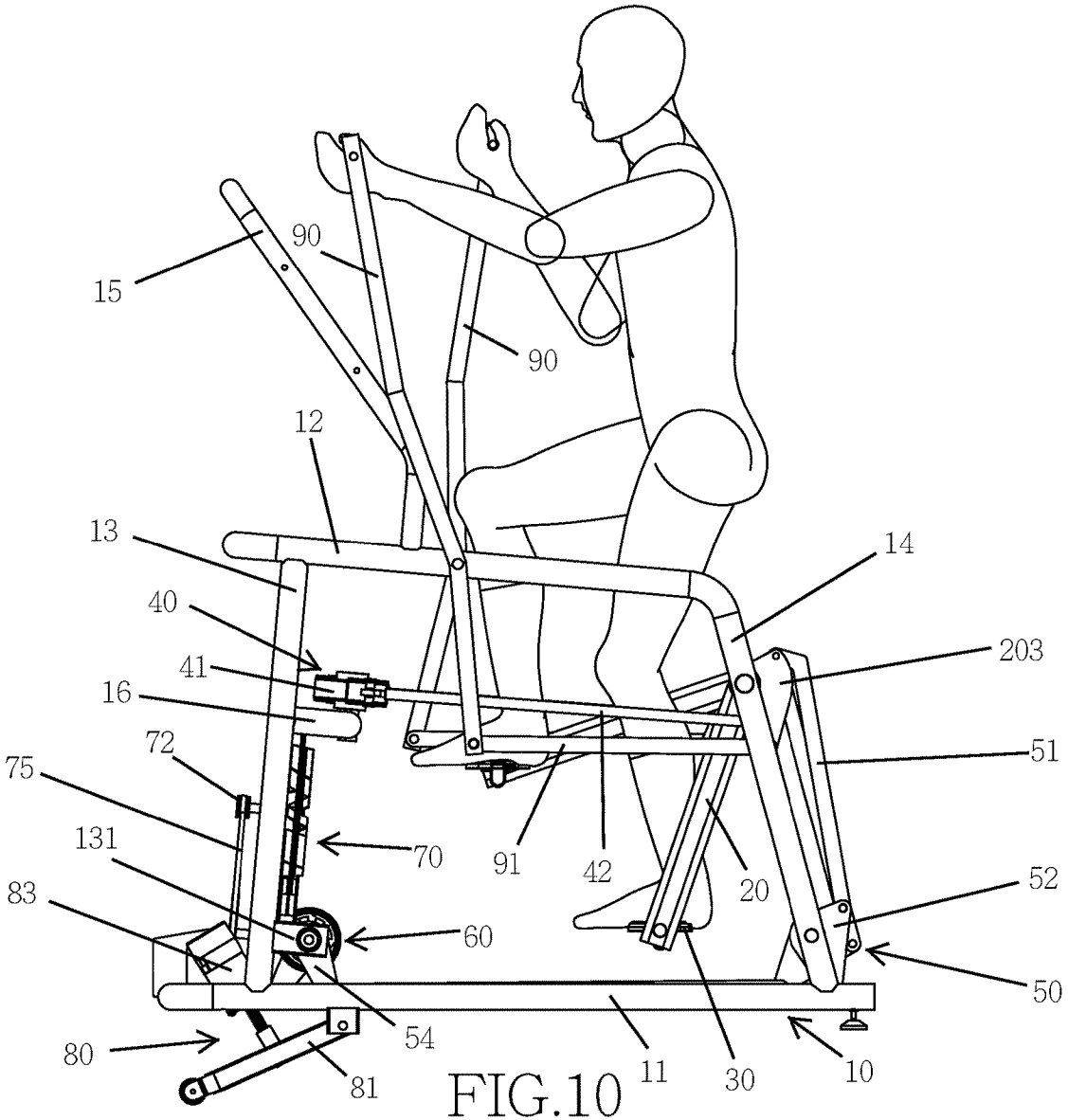
FIG. 10 is a side operational view of the leg lift machine as shown in FIG. 5.

In operation, referring to FIG. 10 with reference to FIGS. 4-9, when the two drive levers 20 swing, the pivot portion 203 of the upper end 201 of each of the two drive levers 20 in turn drives the rear swinging lever 51, the rear pivot member 52, the lower swinging lever 53, and the front pivot member 54 of each of the two swinging mechanisms 50, so that the shaft 61 is driven to rotate reciprocally by the front pivot member 54 of each of the two swinging mechanisms 50. Then, the shaft 61 in turn drives the first bevel gear 62, the second bevel gear 63, the belt wheel 71, the transmission belt 75, the rotation wheel 72, and the magnetically controlled wheel 73, so that the magnetically controlled wheel 73 is rotated. When the magnetically controlled wheel 73 is rotated relative to the magnetic bracket 74, the magnetic bracket 74 provides a magnetic resistance to the magnetically controlled wheel 73 to apply a damping force to the two drive levers 20 so that the user has to overcome the damping force to achieve an exercising effect.

In addition, the lifting mechanism 80 is operated to lift or lower the main frame unit 10, to further adjust different inclined angles of the main frame unit 10.

Further, the user stands on the two pedals 30, with his/her two hands holding the two handlebars 90 and two feet treading the two pedals 30 to drive and move the two drive levers 20. When the two drive levers 20 swing, the two linking levers 91 are driven so that the two handlebars 90 are driven to swing forward and backward.

Referring to FIGS. 11-14, the pivot portion 203 of the upper end 201 of each of the two drive levers 20 is a wheel (or roller). The leg lift machine comprises two linkage mechanisms 40. Each of the two linkage mechanisms 40 drives the pivot portion 203 of the upper end 201 of each of the two drive levers 20. Each of the two linkage mechanisms 40 includes at least two fixed pulleys 44 pivotally mounted on the bottom frame 11 of the main frame unit 10. A rope (or wire) 43 is mounted (or wound) around the pivot portion 203 of the upper end 201 of each of the two drive levers 20 and the at least two fixed pulleys 44 of each of the two linkage mechanisms 40. Thus, the at least two fixed pulleys 44 of each of the two linkage mechanisms 40 are connected with the pivot portion 203 of the upper end 201 of each of the two drive levers 20 by the rope 43.

In the preferred embodiment of the present invention, the leg lift machine further comprises two swinging mechanisms 50. Each of the two swinging mechanisms 50 includes at least one rear swinging lever 51 and a front pivot member 54. The rear swinging lever 51 has an upper end (or first end) pivotally connected with the pivot portion 203 of the upper end 201 of one of the two drive levers 20. The rear swinging lever 51 has a lower end (or second end) pivotally connected with a first end of the front pivot member 54. The front pivot member 54 has a second end radially secured on the shaft 61. The shaft 61 extends through the front pivot member 54 of each of the two swinging mechanisms 50.

Figure 11:
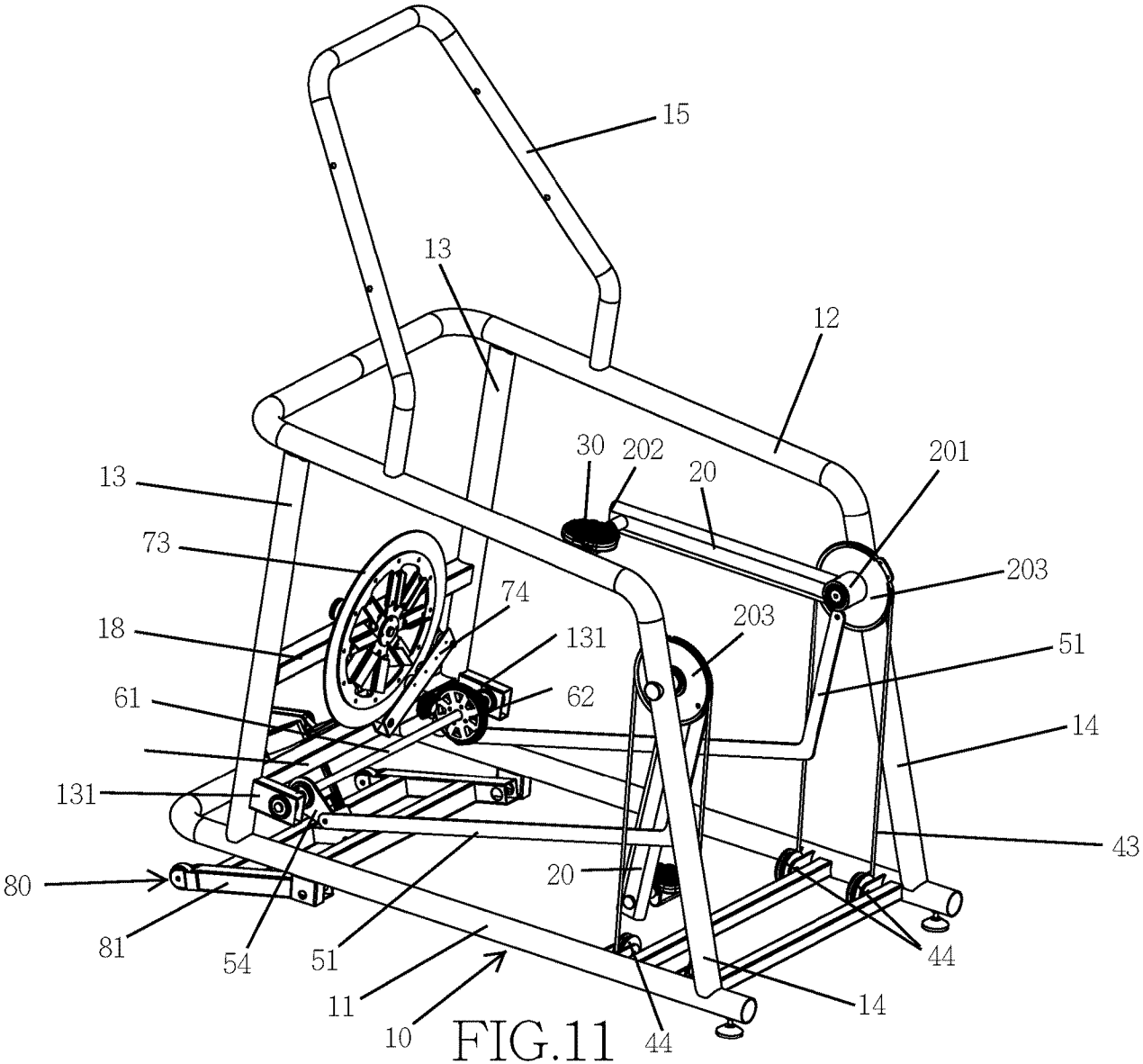
FIG. 11 is a perspective view of a leg lift machine in accordance with the fourth preferred embodiment of the present invention.
Figure 12:
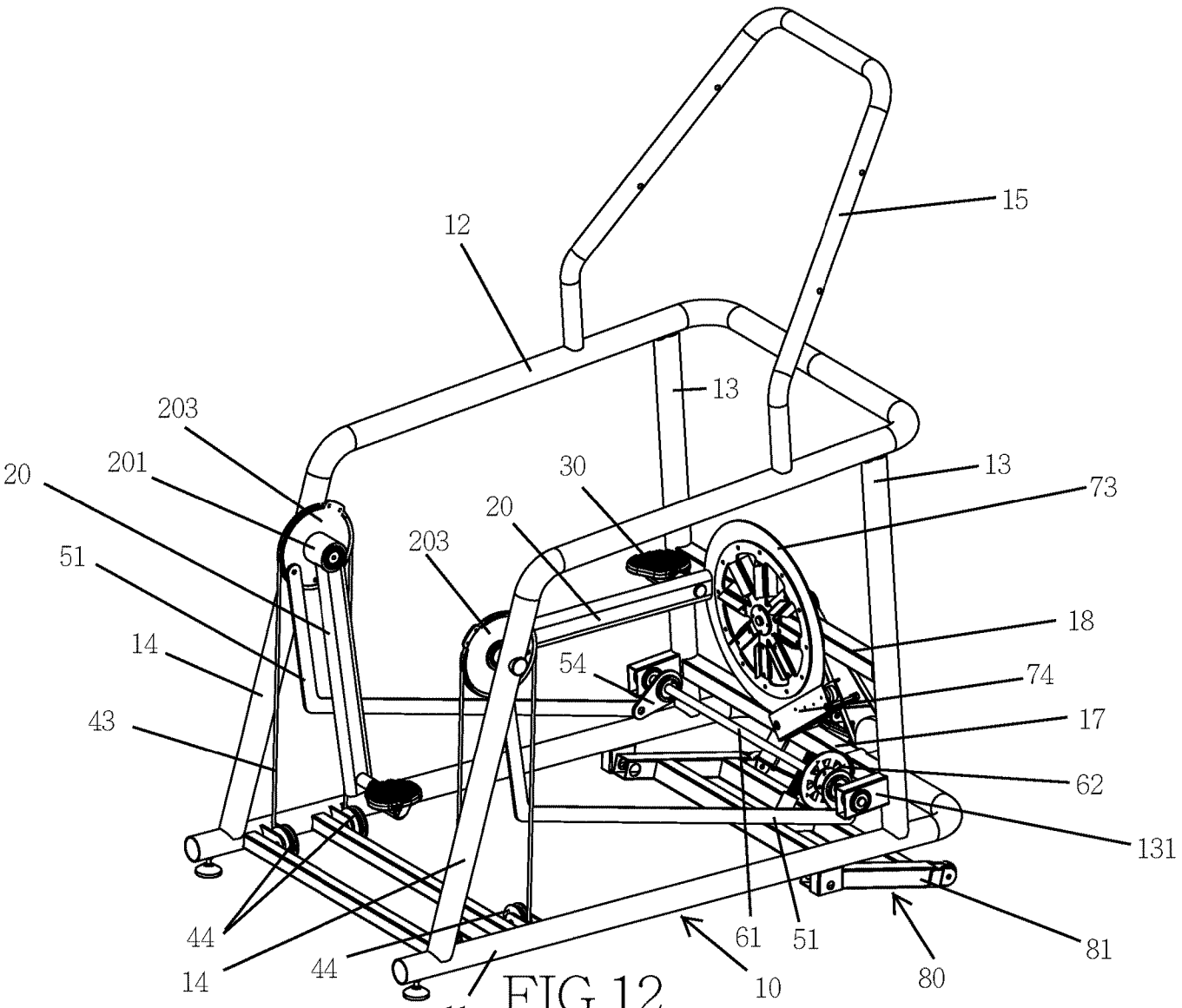
FIG. 12 is another perspective view of the leg lift machine in accordance with the fourth preferred embodiment of the present invention.
Figure 13:
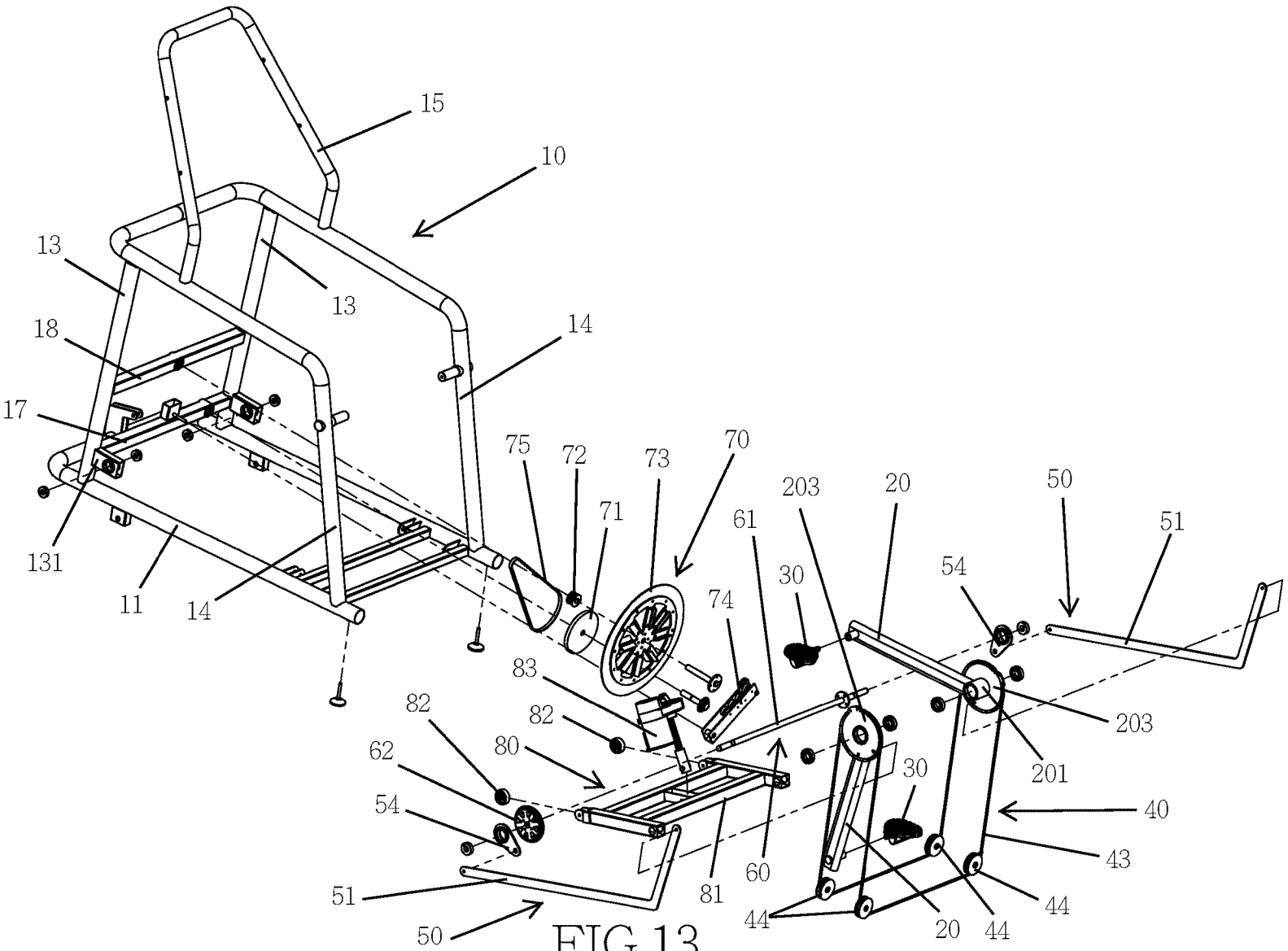
FIG. 13 is an exploded perspective view of the leg lift machine as shown in FIG. 11.
Figure 14:
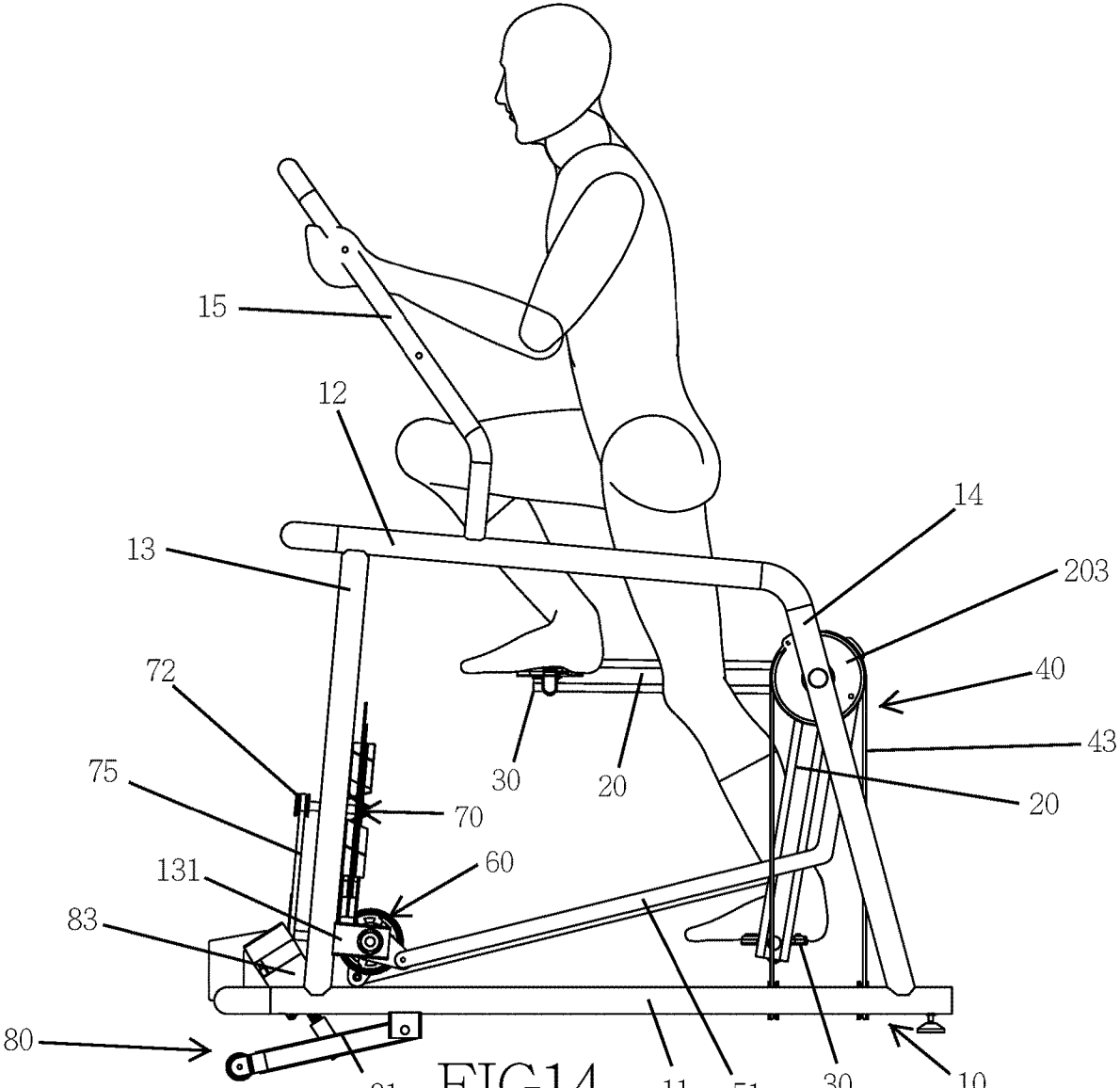
FIG. 14 is a side operational view of the leg lift machine as shown in FIG. 11.

In operation, referring to FIG. 14 with reference to FIGS. 11-13, when the two drive levers 20 swing, the pivot portion 203 of the upper end 201 of each of the two drive levers 20 in turn drives the rear swinging lever 51 and the front pivot member 54 of each of the two swinging mechanisms 50, so that the shaft 61 is driven to rotate reciprocally by the front pivot member 54 of each of the two swinging mechanisms 50. Then, the shaft 61 in turn drives the first bevel gear 62, the second bevel gear 63, the belt wheel 71, the transmission belt 75, the rotation wheel 72, and the magnetically controlled wheel 73, so that the magnetically controlled wheel 73 is rotated. When the magnetically controlled wheel 73 is rotated relative to the magnetic bracket 74, the magnetic bracket 74 provides a magnetic resistance to the magnetically controlled wheel 73 to apply a damping force to the two drive levers 20 so that the user has to overcome the damping force to achieve an exercising effect. At this time, when the two drive levers 20 swing, the pivot portion 203 of the upper end 201 of each of the two drive levers 20 drives the rope 43 so that the rope 43 encircles and is moved around the pivot portion 203 of the upper end 201 of each of the two drive levers 20 and the at least two fixed pulleys 44 of each of the two linkage mechanisms 40.

Accordingly, the leg lift machine of the present invention has the following advantages.

1. The linkage mechanism 40 has a link type or a steel rope type so that the linkage mechanism 40 is assembled easily and quickly, is not damaged easily, is easy to repair, and has a lower cost of assembly and fabrication.
2. The magnetically controlled wheel 73 of an inertia type is used to cooperate with the magnetic bracket 74 of a magnet type so that the magnetically controlled resistance mechanism 70 has a higher stability and is adjusted and repaired easily. In addition, the magnetically controlled wheel 73 has an inertia effect during rotation, to provide a preferable sport mode to the user.
3. When the user enters the leg lift machine from the rear side of the main frame unit 10 of a frame type, the bottom frame 11, the upper support frame 12, the two first stands 13, and the two second stands 14 support the user steadily so that the leg lift machine will not lean or fall leftward or rightward when the user's two legs are lifted reciprocally. In addition, the main frame unit 10 separates the user from other people to enhance the safety of use.
4. The lifting mechanism 80 is operated to lift or lower the main frame unit 10, and to adjust different inclined angles of the main frame unit 10 when the user's two legs are lifted reciprocally and when the user's two arms swing reciprocally so that the user can exercise the core muscles with different training intensity.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A leg lift machine comprising:

a main frame unit, two drive levers, two pedals, and a linkage mechanism;

wherein:

the main frame unit includes a bottom frame, an upper support frame, two first stands, two second stands, and a handle rack;

the two first stands are connected between the bottom frame and the upper support frame and arranged at a front side of the main frame unit;

the two second stands are connected between the bottom frame and the upper support frame and arranged at a rear side of the main frame unit;

the handle rack is connected with and extends upward from the upper support frame;

each of the two drive levers has an upper end and a lower end;

the upper end of each of the two drive levers is provided with a pivot portion extending outward;

the upper end of each of the two drive levers is pivotally mounted on one of the two second stands of the main frame unit;

the upper end of each of the two drive levers serves as a rotation fulcrum, and the two drive levers are configured to pivot relative to the main frame unit and reciprocally swing forward and backward and move along a curved trajectory;

each of the two pedals is pivotally mounted on the lower end of one of the two drive levers;

the linkage mechanism has a first end pivotally connected with the main frame unit and a second end pivotally connected with the pivot portion of the upper end of each of the two drive levers;

a second front support is securely connected with the front side of the main frame unit;

the second front support is arranged transversely;

a third front support is securely connected with the front side of the main frame unit;

the third front support is arranged transversely;

the main frame unit further includes two pivot ears mounted on the two first stands;

the leg lift machine further comprises a transmission mechanism and a magnetically controlled resistance mechanism;

the transmission mechanism includes a shaft, a first bevel gear, and a second bevel gear;

the shaft has two ends pivotally mounted on the two pivot ears;

the first bevel gear is axially secured on the shaft;

the second bevel gear is pivotally mounted on the second front support and meshes with the first bevel gear;

the magnetically controlled resistance mechanism is driven by the second bevel gear and provides a resistance to the second bevel gear;

the magnetically controlled resistance mechanism at least includes a belt wheel, a rotation wheel, a magnetically controlled wheel, a magnetic bracket, and a transmission belt;

the magnetically controlled wheel is pivotally mounted on the third front support;

the magnetic bracket is securely connected with the second front support and surrounds a periphery of the magnetically controlled wheel;

the belt wheel is pivotally mounted on the second front support and is rotated in concert with the second bevel gear synchronously;

the belt wheel is coaxial with the second bevel gear;

the rotation wheel is pivotally mounted on the third front support and is rotated in concert with the magnetically controlled wheel synchronously:

the rotation wheel is coaxial with the magnetically controlled wheel; and the transmission belt is mounted around the belt wheel and the rotation wheel.

2. The leg lift machine as claimed in claim 1, wherein the main frame unit has a cuboid shape.

3. The leg lift machine as claimed in claim 1, wherein:

a first front support is securely connected with the front side of the main frame unit;

the first front support is arranged transversely;

the linkage mechanism includes a swing base and two linkage rods;

the swing base is pivotally mounted on the first front support and symmetrically swings leftward and rightward;

each of the two linkage rods has a front end pivotally connected with one of two ends of the swing base;

each of the two linkage rods has a rear end pivotally connected with the pivot portion of the upper end of one of the two drive levers; and the two drive levers are limited by the swing base and the two linkage rods to reciprocally swing forward and backward.

4. The leg lift machine as claimed in claim 1, further comprising:

two handlebars pivotally mounted on two sides of the main frame unit; and two linking levers each having a front end pivotally connected with a lower end of one of the two handlebars and a rear end pivotally connected with the pivot portion of the upper end of one of the two drive levers.

5. The leg lift machine as claimed in claim 1, further comprising:

two swinging mechanisms;

wherein:

each of the two swinging mechanisms includes a rear swinging lever, a rear pivot member, a lower swinging lever, and a front pivot member;

each rear pivot member is pivotally mounted on one of the two second stands of the main frame unit;

each rear swinging lever has an upper end pivotally connected with the pivot portion of the upper end of one of the two drive levers;

each rear swinging lever has a lower end pivotally connected with a first end of the respective rear pivot member;

each rear pivot member has a second end pivotally connected with a rear end of the respective lower swinging lever;

each lower swinging lever has a front end pivotally connected with a first end of the respective front pivot member; and each front pivot member has a second end radially secured on the shaft.

6. The leg lift machine as claimed in claim 1, further comprising:

a lifting mechanism mounted on a front section of a bottom of the main frame unit;

wherein:

the lifting mechanism drives the main frame unit to lift or lower the main frame unit, to further change different inclined angles of the main frame unit;

the lifting mechanism includes a lifting rack, two rollers, and a lifter;

the lifting rack has a first end pivotally connected with the main frame unit;

the lifting rack has a second end pivotally connected with the two rollers; and the lifter is mounted between the main frame unit and the lifting rack and has a first end pivotally connected with the main frame unit and a second end pivotally connected with the lifting rack.

* * * * *